United States Patent [19]

Clark, Jr. et al.

[11] Patent Number: 4,625,946

[45] Date of Patent: Dec. 2, 1986

[54] HOIST HAVING WORM SAFETY DEVICE

[75] Inventors: Charles W. Clark, Jr.; Harold H. West, both of King County, Wash.

[73] Assignee: Ederer Incorporated, Seattle, Wash.

[21] Appl. No.: 590,630

[22] Filed: Mar. 19, 1984

[51] Int. Cl.[4] ..... B66D 1/48; B66D 1/14

[52] U.S. Cl. ..... 254/274; 254/340; 254/343; 254/351

[58] Field of Search ..... 254/267, 274, 275, 292, 254/295, 296, 298, 299, 304, 305, 339, 340, 343, 345, 346, 350, 351, 368, 356

[56] References Cited

U.S. PATENT DOCUMENTS

| | | | |
|---|---|---|---|
| 647,239 | 4/1900 | Sprague . | |
| 898,782 | 9/1908 | Rasmus . | |
| 1,490,671 | 4/1924 | Lindstrom et al. . | |
| 1,768,420 | 6/1930 | Rogers . | |
| 1,885,458 | 11/1932 | Maniscalco . | |
| 2,300,343 | 10/1942 | Clay . | |
| 2,652,230 | 9/1953 | Hoyle et al. . | |
| 2,884,800 | 5/1959 | Carroll . | |
| 2,903,901 | 9/1959 | MacDonald . | |
| 3,063,708 | 11/1962 | Wollenhaupt . | |
| 3,477,695 | 11/1969 | Noly . | |
| 3,541,888 | 11/1970 | Hegar et al. . | |
| 3,572,482 | 3/1971 | Kalpas et al. | 254/267 X |
| 3,836,121 | 9/1974 | Jones . | |
| 4,175,727 | 11/1979 | Clark . | |
| 4,177,973 | 12/1979 | Miller et al. . | |

FOREIGN PATENT DOCUMENTS

| | | | |
|---|---|---|---|
| 140640 | 2/1935 | Austria | 254/274 |
| 895514 | 9/1953 | Fed. Rep. of Germany | 254/274 |
| 950003 | 2/1964 | United Kingdom | 254/274 |

*Primary Examiner*—Stuart S. Levy
*Assistant Examiner*—Joseph J. Hail, III
*Attorney, Agent, or Firm*—Seed and Berry

[57] ABSTRACT

A hoist having a worm safety device in which the worm is continuously meshed with a worm wheel coupled to the drum. The worm is accelerated to a speed greater than that of the worm wheel and at a torque sufficient to overcome the frictional contact between the worm and worm wheel when the hoist direction is reversed.

28 Claims, 12 Drawing Figures

HOIST HAVING WORM SAFETY DEVICE

TECHNICAL FIELD

This invention pertains to hoists, and more particularly, to hoists having safety features to prevent dropping or damaging the load because of a failure within the hoist drive system or other hazard conditions. A preferred embodiment also protects the hoist from load hang-up, two-blocking, or overspeed.

BACKGROUND ART

Many cranes and other hoists that handle critical loads, such as for steel mill use, require failure-proofing safety measures because the potential consequences of dropping a load may be serious. U.S. Pat. Nos. 4,175,727 and 4,177,973 disclose safety systems which enable a brake to engage the drum in a hazard condition, such as when there is a discontinuity between the rotational inputs from two inputs to an out-of-sync detector device.

U.S. Pat. No. 3,836,121 shows a hoist with a safety system in which an independently drive worm is continuously meshed with a worm wheel on the drum. The drive to the worm is insufficient to power the worm wheel during normal operation. In the event of a failure in the drive train to the drum, the worm automatically locks up the worm wheel to prevent dropping of the load.

DISCLOSURE OF INVENTION

It is an object of this invention to provide an improved worm/worm-wheel type of automatic safety device which automatically advances the worm tooth away from the next rearward worm wheel tooth in the direction of travel when these teeth are traveling in the same direction during normal operations, but allows the worm tooth to lock up the worm wheel when the teeth are moving in opposite directions or when the worm wheel tries to overrun the worm in the same direction, as in hazard conditions.

It is another object of this invention to provide an improved irreversible gearing type of safety device in combination with shock absorption and torque-limiting devices for protecting the hoist drive and irreversible gearing in the event of locking up the drum during a hazard condition.

It is another object of this invention to provide a hoist which has a worm wheel, a worm in continuous driving engagement with the worm wheel, and a synchronizing device for allowing the worm wheel and worm to mesh without substantial interference during normal operation, but lock the worm wheel with the worm in abnormal operation.

Basically, these objects are obtained in a preferred embodiment by providing a high-torque rotational accelerating drive to the worm which is automatically applied and at a greater speed than is the rotational speed of the worm wheel so that a tooth on the worm is automatically accelerated away from the next rearward meshing pushing tooth in the direction of rotation of the worm wheel when they are traveling in the same direction to avoid interference.

In one embodiment, the acceleration force is also automatically discontinued so that the worm tooth is not advanced in continuous frictional engagement with the next forward worm wheel tooth. Once the worm tooth has been accelerated to move away from the pushing worm wheel tooth, the accelerating drive may reach a steady state condition in which the torque imposed on the worm tooth by the accelerating drive will substantialy equal the torque imposed on the worm tooth by the pushing worm wheel tooth. These two forces may remain in approximate balance until some change occurs in the speed of the worm wheel. In some instances, however, the acceleration force may intermittently be applied. In either case, however, the function is the same, namely, to keep the worm tooth away from constant frictional engagement with the next rearward pushing tooth on the worm wheel. Furthermore, part of the resilient mounting in the axial positioning of the worm allows for axial movement of the worm to accommodate the relative velocity changes between the worm and the worm wheel teeth. The worm tooth accelerating drive is operable only when the teeth on the worm and the worm wheel are traveling in the same direction during normal hoisting or lowering of a load. When the directional rotations between the worm and the worm wheel become opposite or when the worm wheel tries to run faster than the worm in the same direction, such as where the drive train has broken and a hoisted load suddenly falls and begins to rotate the drum in the opposite direction in a hoist condition or faster but the same direction in a lowering condition, the accelerating drive does not allow the drum to accelerate, so the worm wheel tooth is pushed into locking frictional engagement with the worm tooth to stop the drum.

In another embodiment, a high-torque accelerating drive moves the worm tooth away from the next rearward worm wheel tooth in the direction of travel of the worm wheel and continues to advance the worm tooth until it engages the next forward worm wheel tooth. Just prior to the engagement with the next forward worm wheel tooth, the torque is reduced in the worm-accelerating drive to a lower limited torque at which it remains until some change occurs in the operating condition (speed or direction) of the hoist. Preferably, in this embodiment, a differential drive and electrically energized clutch varies the torque on the worm-accelerating drive.

In one embodiment, the drive to accelerate the worm tooth is a secondary drive taken from the last high-speed, load-carrying component of the hoist. In another embodiment, the accelerating drive for the worm tooth is from a separate, independent secondary motor, normally of a size which will not be able to drive the worm wheel, if the worm wheel is carrying the load of the hoist, at a normal operating speed. Both embodiments may be provided with an auxiliary manual or motor-driven gear reduction unit attached to the worm for slowly lowering the load after an emergency stop or for inching loads.

Preferably, in some embodiments an overspeed protection device is provided to interrupt the accelerating drive to the worm so that the worm stops the worm wheel during an overspeed condition.

Since the worm will have to resist the substantial kinetic energy in the hoist drive train system during an emergency stop by the worm, the worm is preferably mounted for shock absorption by resiliently mounting the worm for limited axial movement and the drive train is provided with a torque-limiting device which will allow the remaining excess kinetic energy of the drive train to be dissipated rather than being passed on to the worm through the worm wheel.

The hoist system as described advantageously provides a worm as an emergency braking device that normally operates without interference between the worm and worm wheel teeth and is always continuously engaged to stop the drum, but importantly is capable of absorbing and dissipating the kinetic energy when the drum does get stopped by the worm.

Manufacturing tolerances and the fact that the worm wheel must be reversed when going between hoist and lowering directions and vice versa make it almost impossible to obtain perfect synchronization between the worm and the worm wheel to avoid frictional interference. If the teeth of the worm and worm wheel were allowed to continuously rub against one another, at a high torque necessary to disengage the teeth during a change in hoist direction, the constant friction would wear the teeth, cause frictional lock-up between the teeth, or result in having the worm drive the worm wheel.

A unique advantage of the tooth accelerating drive for moving the worm tooth away from the next rearward worm wheel tooth is that the continuously engaged worm creates minimal friction contact with the worm wheel during normal operation.

It has also been discovered that the amount of torque necessary to move the worm tooth at a greater speed than the worm wheel tooth away from the worm wheel tooth when the hoist and thus the worm wheel is reversed in a normal directional change is significantly more than the torque which pushed the worm tooth against the worm wheel initially. That is, during normal hoisting operation, the worm wheel and the worm will be turned in the same relative rotational directions so that the teeth are moving in the same directions. When the operator decides to reverse the hoist, however, and lower the load, the worm wheel will immediately begin to rotate in the opposite direction. The worm also will be signaled to turn in the opposite direction; but due to tolerances and gear backlash, the worm wheel tooth may engage the worm tooth. This will create a frictional interlocking between the teeth which must be overcome by providing sufficiently greater torque and at a higher speed than the worm wheel is turning so as to move the worm tooth away from the worm wheel tooth. This higher torque is provided either by the separate secondary drive motor or by the secondary drive from the main drive, but must be delivered through clutching devices that are automatically disengaged to prevent the secondary drive or the separate secondary drive motor from driving the worm tooth against the worm wheel tooth at a continuous high torque. A further important feature is that the secondary drive or secondary drive motor are engaged automatically by the axial position of the worm.

In one embodiment, the axial position of the worm occurs directly from pushing of the worm tooth by the worm wheel tooth. This enables the worm to accelerate automatically to move the pushed worm tooth away from the pushing worm wheel tooth to effect a form of steady state general sychronization between the worm and the worm wheel. The frequency of the tooth pushing and worm acceleration is such that the worm may appear to be continuously driven in synchronism with the worm wheel. In another embodiment, the axial positioning of the worm and the relative direction of the worm and worm wheel determines the amount of torque applied to the accelerating worm drive. Thus the movement of the worm and worm wheel are defined as "generally synchronized," although the initiation of steady state synchronization must be repeated after each reverse of hoist operation when the worm tooth must be accelerated away from the pushing worm wheel tooth.

In another embodiment, the axial movement of the worm caused by a hazard condition can be used to actuate a switch to set a brake directly on the drum or the worm can provide the motive power to set a brake on the drum in a manner similar to that shown in patent applications Ser. No. 475,684 now U.S. Pat. Nos. 4,493,479 filed Mar. 14, 1983 and 317,054 now U.S. Pat. No. 4,518,153 filed Nov. 2, 1981, or U.S. Pat. Nos. 4,177,973 and 4,175,6727, all owned by the common assignee hereto.

BEST MODE FOR CARRYING OUT THE INVENTION

Figure 1:
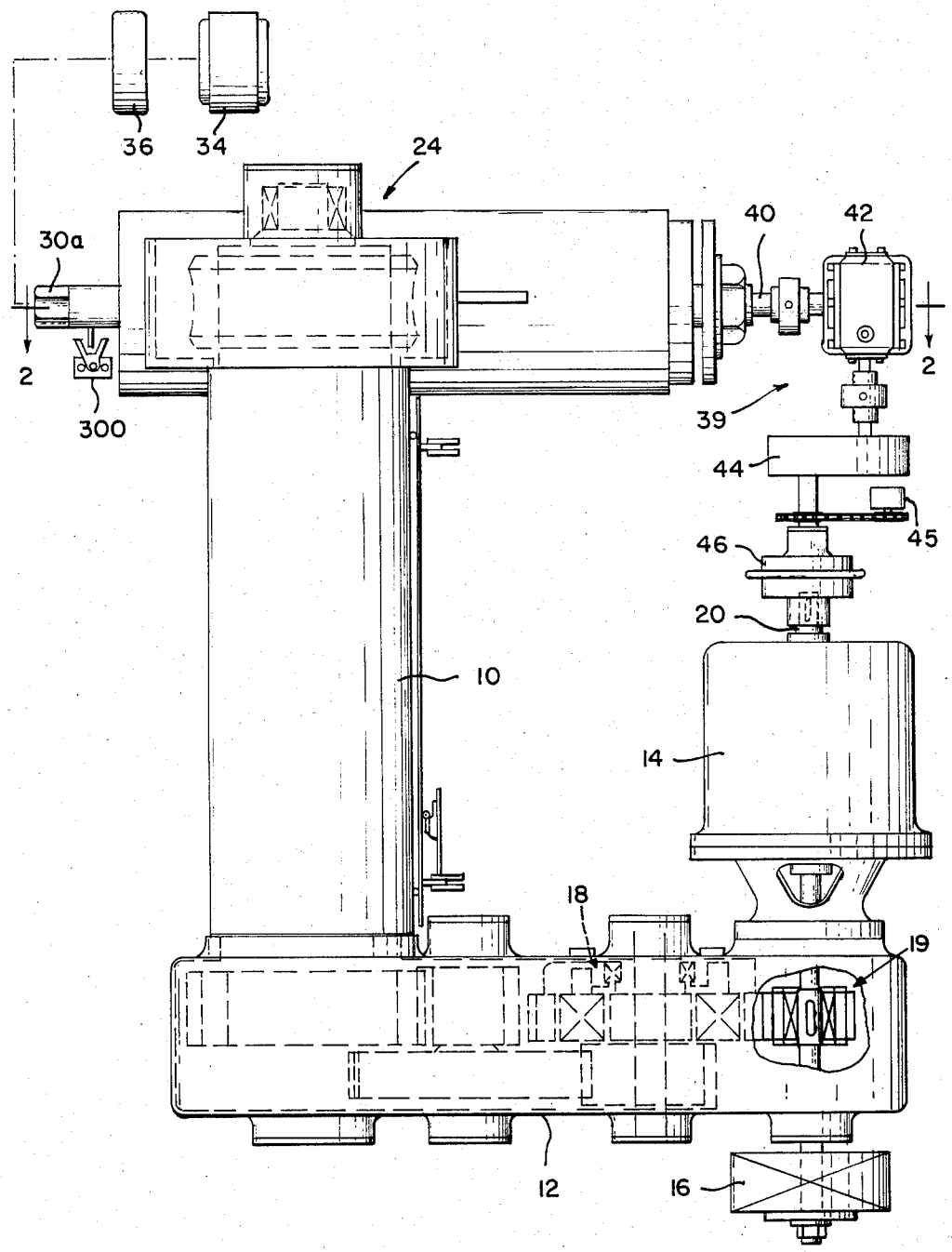
FIG. 1 is a schematic plan view of a typical hoist system embodying the principles of the invention.

The overall hoist system is best shown in FIG. 1 and includes a drum 10 driven through a power transmission main drive 12 by a main drive motor 14. The motor is provided with a conventional operating brake 16. A unique torque limiting device 18 of the type shown in U.S. Pat. No. 4,175,727 is provided in the main drive. The details of the torque limiting device are shown in U.S. Pat. No. 4,175,727, the disclosure of which is incorporated herein by reference thereto. Essentially, the torque-limiting device includes a set of friction discs which are pre-compressed together to transmit only a limited amount of torque. The purpose of the torque-limiting device is to dissipate the high-speed kinetic energy of the upstream or high-speed components of the drive and motor in the event of two-blocking, load-hangup, or other hazard condition.

The motor shaft 20 of the system shown is the last upstream or high-speed load-carrying component of the winch system. That is, if the motor shaft should break and the motor can no longer support the load, then the load would drop but for the operating brake 16. Sometimes, however, the operating brake 16 is placed upstream of the motor 14 on the motor shaft 20. The brake shaft then becomes the highest upstream load-carrying component of the drive.

In a preferred embodiment, a conventional one-way or sprag clutch 19 allows the motor to power rotation of the main drive in a hoist direction but prevents the motor from powering the main drive in a lowering direction. This feature precludes the motor from inadvertently increasing the load on the worm 30 in an emergency condition. In many hoists, down-driving or powered lowering of the main drive is not a requirement or the sizing of the worm is such as to accommodate overloads. In such cases, the sprag 19 is not required.

The drum is uniquely engaged by a worm gear assembly 24 at all times. The drum is attached to a conventional worm wheel 26 having teeth 28. A worm 30 having teeth 31 in mesh with the worm wheel teeth is journaled in a housing 32. A standard worm brake system illustrating essentially a worm and a worm wheel and the advantages derived therefrom can be found in U.S. Pat. No. 3,836,121, the details of which are incorporated herein by reference thereto. As will be explained below, one end of the worm is driven in general synchronism with the worm wheel but at a greater speed either by a separate secondary motor, as in U.S. Pat. No. 3,836,121, or by a secondary drive from the main drive motor 14.

In a preferred embodiment, the opposite end of the worm can be splined for axial movement relative to and be driven by a small auxiliary motor and gear reduction unit 34 brought into operation by a normally open clutch 36. The unit 34 normally is not connected to the worm, but rather is available as an emergency load lowering or hoisting device in the event a hazard condition has occurred. That is, should the main drive fail, the worm wheel will jam against the worm 30 and stop the drum. The load can then be lowered by coupling the drive unit 34 through the clutch 36 to rotate the worm and thus allow the drum to rotate slowly and lower the load. This is an important feature of a preferred embodiment of the invention, as it is desirable to be able to lower or hoist the load safely when a failure or hazard condition occurs rather than attempting to first repair the hoist. In the alternative, of course, a wrench could be attached to a wrench head portion of the shaft **30*a* (FIG. 1) to manually rotate the worm to lower the load as necessary. A advantage of a motor and drive unit 34** is that the worm can be used in normal operation for inching or making slow movements of the load, as is somtimes desirable.

It should be understood that as described above the worm wheel in this instance is the last convenient downstream or last low-speed component of the drive system. If desired, the worm wheel could be placed on a pinion which is in meshing engagement with a bull gear or the like on the drum. The worm wheel would remain the last low-speed, load-carrying component of the system even though coupled to the drum by the pinion.

The worm preferably has a non-reversing gear ratio; therefore the worm wheel, and thus the drum, cannot rotate at a significantly different rate of speed or in a direction opposite to that in which the worm is being driven. In the embodiment illustrated in FIGS. 1 and 2, the worm is shown as driven by a secondary drive 39, including a shaft 40 which is coupled through a right angle drive 42 to a gear reduction unit 44. The gear reduction unit is driven through a conventional electrical clutch 46. An overspeed switch 45 is also coupled to the secondary drive to stop the motor 14 and set the operating brake 16 in an overspeed condition. In the alternative overspeed can be handled by a separate centrifugal clutch as shown in FIG. 3. In an embodiment in which the secondary drive is a separate secondary motor, then an overspeed switch need not be used as the electrical power controls to that secondary motor, and thus the speed of that secondary motor, will function independently of the main drive motor 14 and will lock up the worm wheel if motor 14 goes overspeed.

The worm will be driven by the secondary drive in general synchronism both in speed and direction to that of the worm wheel. That is, the drive to both the worm wheel and the worm in the embodiment of FIGS. 1 and 2 originates from the motor shaft 20, with the gear reduction units in the main drive and in the gear reduction unit 44 matched to provide general predetermined speed ratios between the two. As will be explained below, the ratios are not exactly the same, since, as a unique part of this invention, the worm will be driven at a velocity greater than that of the worm wheel. The drive to the worm will thus be termed an "accelerating drive."

Figure 2:
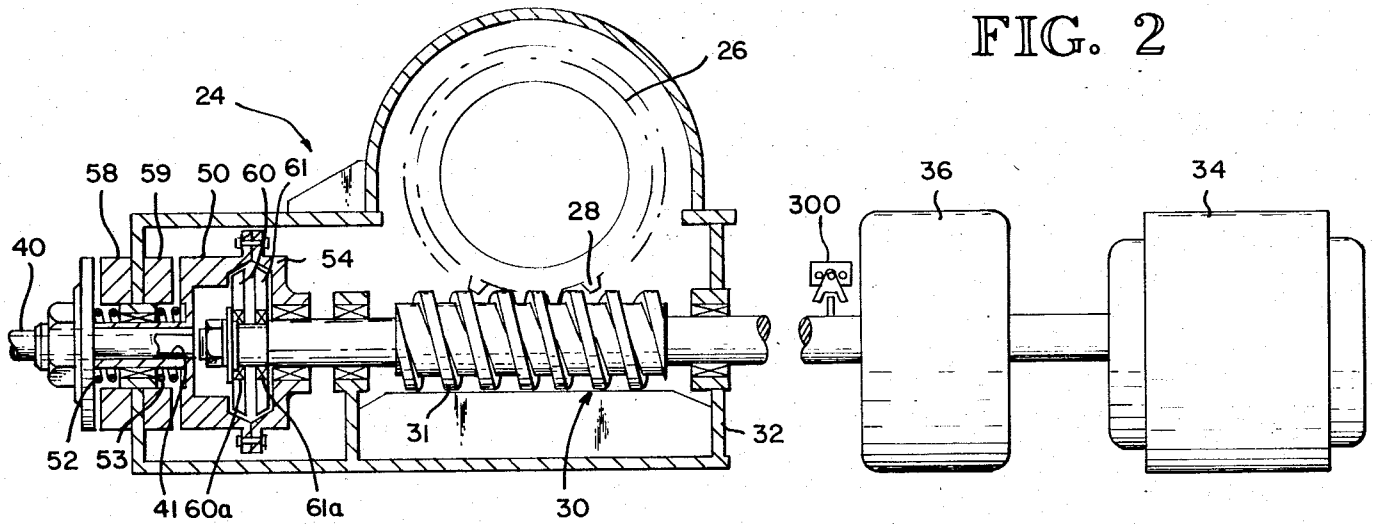
FIG. 2 is a partial vertical section taken along the line 2—2 of FIG. 1.
Figure 3:
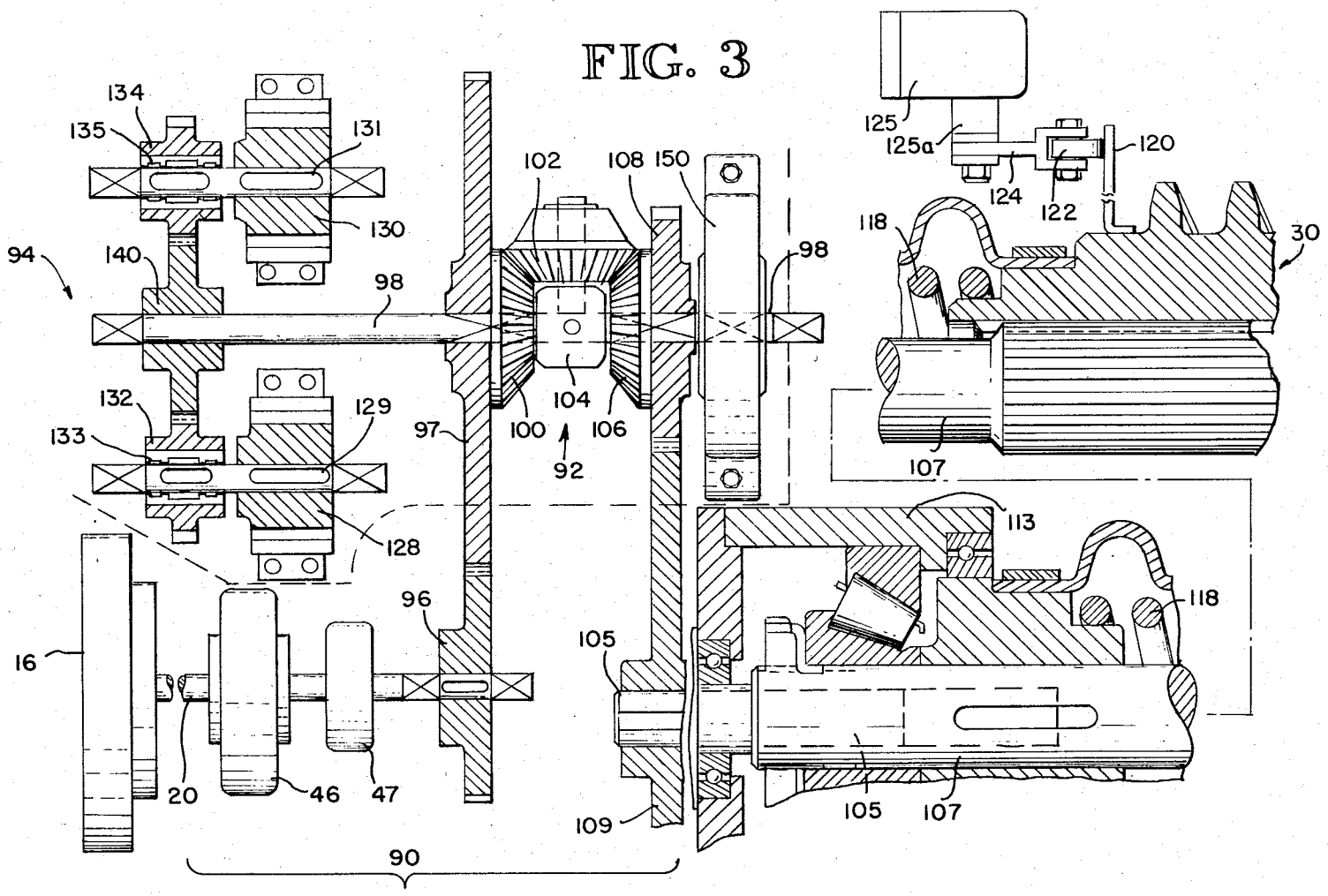
FIG. 3 is a schematic illustration of a second embodiment of the invention which is capable of being used in the hoist system of FIG. 1.

In order to drive the worm at a greater speed than the speed of the worm wheel 26, the housing 32 in the embodiment of FIG. 2 is provided with a left-hand clutch face 50 that is coupled to shaft 40 by splines 41. A right-hand clutch face 54 is pinned to the left-hand clutch face 50. The clutch faces are one form of releasable coupling means. The clutch faces are centered for resilient movement left or right by compression springs 52 and 53. The clutch faces then are rotated so as to rotate the worm in the same direction as the worm wheel 26, but at a higher speed. This causes any tooth 31 on the worm, when the worm is driven by either of the clutch faces 50 and 54, to accelerate and move away from a tooth 28 on the worm wheel when both teeth are traveling in the same direction. The worm becomes driven only when it is shifted axially by the worm wheel pushing against a tooth on the worm until one of the central clutch plates 60 or 61 fixed to the worm contacts either clutch face 50 or 54. The mechanism avoids the obvious problem of gear backlash and minute accumulative slippage in the torque-limiting device which would otherwise cause the worm wheel to lock on the worm, stopping the hoist, or the worm could start driving the drum instead of the main drive train, thereby reducing the hoist efficiency.

Clutch plates 60 and 61 are spragged as at **60*a* and 61*a* (lock up in one direction, freely rotate in the other direction) for rotation fixed to the worm in opposite directions. That is, in a hoisting direction, one clutch plate is locked, while the other clutch plate freely rotates on the worm. In the lowering direction, the previously locked clutch plate can fully rotate and the previously freely rotating clutch plate becomes fixed to the worm. The sprags are conventional and are provided to prevent the worm from locking up when (1) an operator changes the hoist to move suddenly from lowering to hoisting direction, or vice versa, or (2) a two-blocking occurs. Due to slippage in the torque-limiting device 18**, this hoist reversal condition can result in the worm wheel tooth pushing the worm axially the wrong direction to engage the wrong clutch plate and clutch face. In this condition, rotation of the worm in the now reverse direction will cause the worm tooth to try to accelerate, but in the direction to further jam the worm tooth against the worm wheel tooth. The sprag for that engaged clutch plate will then freely rotate in this reversed rotational direction. The worm wheel tooth will move away from the worm tooth allowing the worm to center axially. The worm wheel tooth will then catch up to stationary worm tooth and begin pushing the worm tooth to axially move the worm and engage the correct opposite clutch plate with the correct clutch face. This will then engage the accelerating drive to rotate the worm tooth away from the worm wheel to regain the generally synchronous rotation between the worm and worm wheel.

High tooth tangential friction may also result when the worm wheel rotates against the stationary worm following reversal of the direction of the drum, for example from hoisting to lowering, since the worm will not be driven until all of the backlash has been taken out of the drive train and the secondary drive 39. To avoid these unacceptable conditions, the worm assembly performs three basic functions: (1) levels out the effects of gear backlash and accumulated slippage in the torque limiter 18; (2) limits the tangential tooth friction between the worm and the worm wheel during normal operations; and (3) drives the worm tooth out of engagement with the worm wheel tooth at a higher torque than the engagement torque between the teeth of the worm wheel and worm.

Figures 5A, 5B, 5C, 5D:
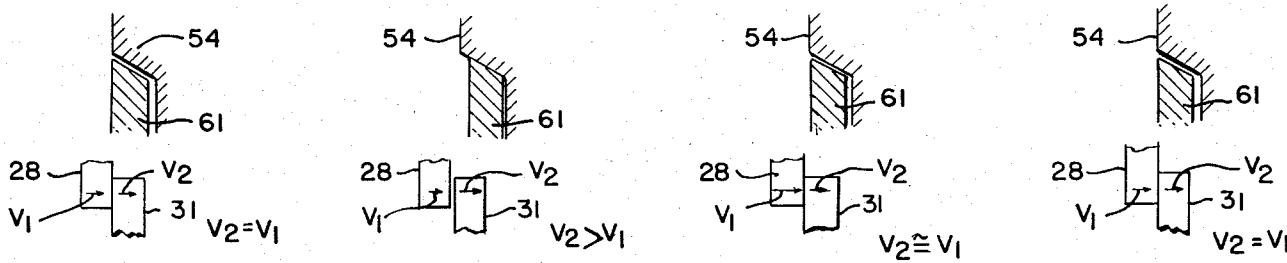
FIGS. 5A–5D are operational schematics illustrating a worm tooth accelerating principle.

In the normal operating modes, the two clutch faces 50 and 54 are operable to drive the worm only in the direction to move a tooth out of engagement with the tooth on the worm wheel and only when such engagement occurs. This results because the force imposed on the worm by the worm wheel to axially shift the worm is the same force which brings the worm clutch plates 60 and 61 into engagement with one of the clutch faces 50 or 54. FIGS. 5A–5D show the automatic clutch operation which moves the worm tooth away from the worm wheel tooth. In FIG. 5A, the tooth 28 on the worm wheel is moving at velocity $V_1$ and begins to engage tooth 31 on worm 30 until tooth 31 is moving at velocity $V_2$ equal to $V_1$. This shifts the worm 30 to the right in FIG. 2, moving the central clutch plate 61 into engagement with clutch face 54 and compressing spring 52. Since clutch face 54 is moving at a velocity which will rotate the worm faster than the worm wheel 26, the tooth 31 will be accelerated to a velocity $V_2$, which is greater then $V_1$, and will begin to move away from tooth 28. This is shown in FIG. 5B.

FIG. 5C shows that once the tooth 31 leaves engagement with the tooth 28, the central clutch plate and right-hand clutch face separate so that the connection between the worm and clutch begins to slip. This results in the worm tooth 31 and worm wheel tooth 28 pushing pressure approximately equaling the slipping drive torque between the clutch plate and clutch face. This engagement of the worm wheel and worm teeth is believed to balance the torque transmitted by the slipping clutch plate and clutch face to cause a general synchronism between the worm wheel tooth and worm tooth velocities, although the worm and worm wheel teeth may be intermittently moved into and out of contact during this condition. The worm may be immersed in oil to decrease the amount of frictional contact between the worm tooth and the worm wheel.

FIG. 5D again shown a starting or hoist reversal condition in which the tooth 28 is again pushing worm tooth 31 to axially move the worm as in FIG. 5A.

Polyurethane bumpers 58 and 59 or other shock absorbers absorb part of the shock loading on the worm when the worm locks the worm wheel in a hazard condition. Most of the system kinetic energy and all of the motor torque will be absorbed by the torque limiter 18 until the motor 14 stops. While the drive to shaft 40, described in the embodiment of FIG. 2, is from a secondary drive 39 from the main drive and motor 14, it should be understood that the drive to shaft 40 can also be a separate secondary drive such as an independent motor of the type shown in U.S. Pat. No. 3,836,121.

Figure 4:
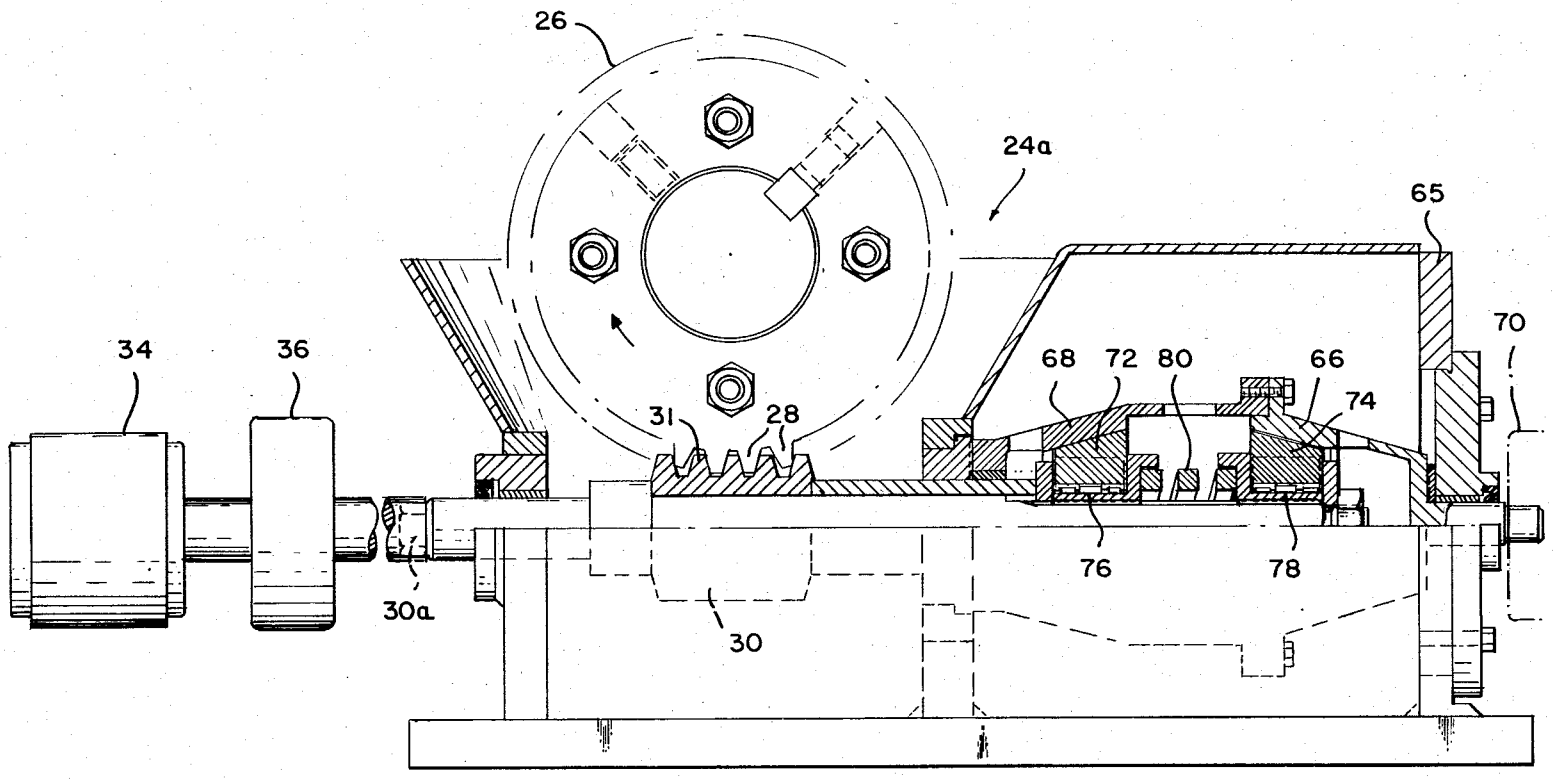
FIG. 4 is a vertical section of a third embodiment of a portion of the hoist system shown in FIG. 1.
Figure 5:
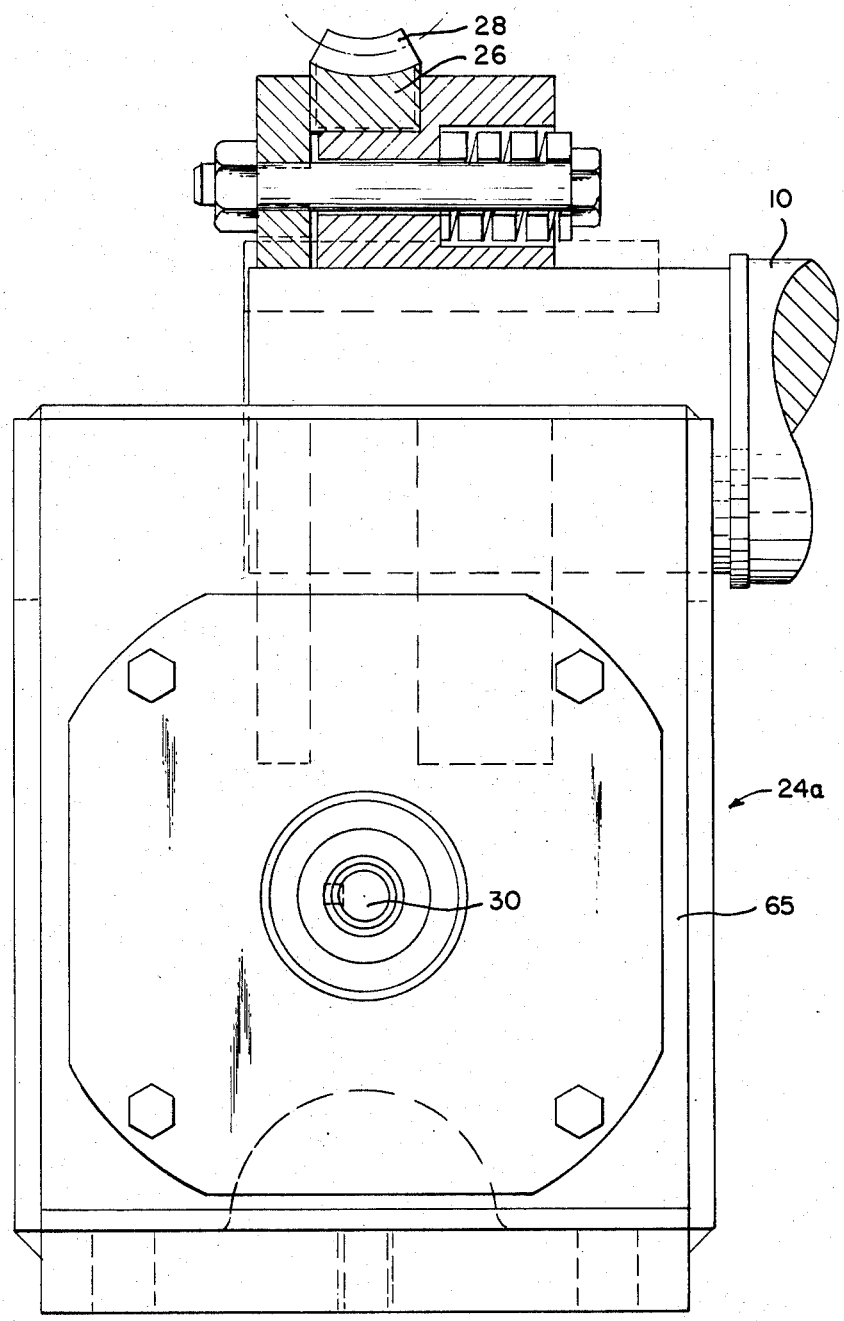
FIG. 5 is an end elevation of the embodiment shown in FIG. 4.

FIG. 4 illustrates another embodiment of a worm assembly **24*a*. As was described with reference to FIG. 2, the worm also has a hex fitting 30*a* for manually lowering the load, and similarly is axially splined to a normally open clutch 36 and an auxiliary motor and gear reduction 34 for inching the load. Still another alternative is to design the worm teeth to allow the worm to be back-driven slightly by the worm wheel for lowering and then place a brake or motor on the worm to provide controlled lowering or raising of the load. The worm 30 meshes with a worm wheel 26 in the same manner as in FIG. 2. A worm housing 65 rotatably mounts a right clutch face assembly 66 and a left clutch face assembly 68. In this embodiment, a secondary motor and gear reduction 70 provides the power for rotating the clutch assemblies. The motor and gear reduction 70 are sized with an inadequate torque to turn the worm wheel when carrying a load. The secondary motor and gear reduction 70 also eliminate the need for separate overspeed devices since the controls to the motor and gear reduction 70 determine the speed thereof independently of the main drive speed. It should be understood, of course, that in this embodiment also, the drive could be a secondary drive from the main drive, such as that shown in FIG. 1**.

The clutch assemblies 66 and 68 are rotated but journaled freely on the worm 30. They are rotated at a speed, however, that will move a tooth on the worm 30 at a greater speed than the tooth on the worm wheel 26, as earlier described. These clutch assemblies 66 and 68 are known as conical clutches. They are adapted to mate with conical left-hand and right-hand inner clutch plates 72 and 74, respectively. The clutch assemblies 66 and 68 and clutch plates 72 and 74 are another form of releasable coupling means. These inner clutch plates are journaled for free rotation in opposite directions to one another respectively on the worm 30 by sprag or one-way clutches 76 and 78, but are keyed to lock and move with the worm when rotated respectively in the opposite directions. A shockabsorbing spring 80 will center the clutch plates and absorb the partial kinetic energy of the system should the worm in an emergency stop be moved either to the right or to the left. For example, if the worm gets pushed to the right, the worm will push inner clutch plate 72 to the right, which will push spring 80 against inner clutch plate 74, and hence against clutch assembly 66, which is fixed against axial movement and the worm will be rotated by clutch assembly 66.

FIG. 4 illustrates the condition at the time tooth 28 is pushing a tooth 31 on the worm to the left. The worm 64 has shifted slightly to the left to engage inner clutch plate 72 with the outer face of clutch assembly 68. This is the same condition as FIG. 5B, in which the tooth 31 will now be advancing away from the tooth 28. As the tooth 31 moves away from tooth 28, the worm 64 will no longer be moved axially by the worm wheel. This will cause clutch plate 72 to slip in assembly 68, and the worm will begin to slow down until an approximate equilibrium is reached between the tooth pushing force and the slipping clutch torque.

In the event of a failure in either embodiment of FIG. 2 or FIG. 4, the worm will lock the worm wheel, stopping the drum. The forces imposed on the worm by the worm wheel during an emergency lock up fully translate the worm and its shaft, actuating an overload switch 300 (FIG. 1). When the switch is actuated, the power is removed to the electric clutch 46 and the hoist motor 14.

Figure 6:
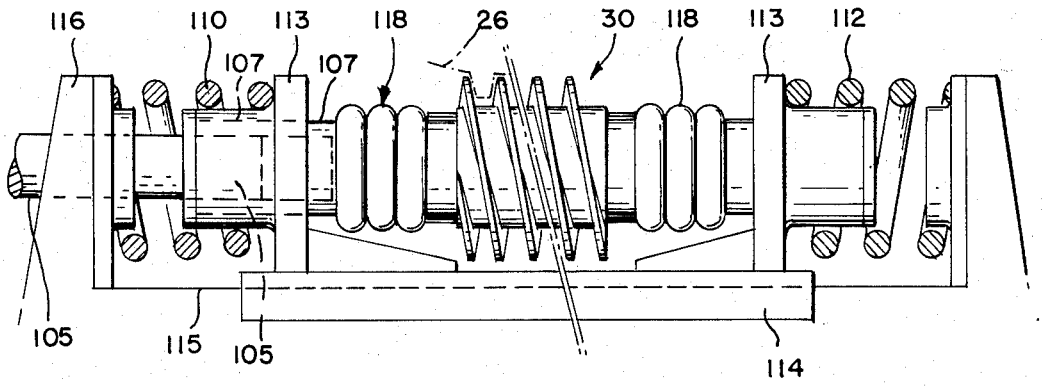
FIG. 6 is a portion of the second embodiment shown in FIG. 3.

Still another embodiment is shown in FIGS. 3 and 6, which will act as a substitute for the clutch-type accelerating drives of FIGS. 2 and 4. In this embodiment, a secondary drive 90 to the worm 30 is driven from the main drive motor 14 (not shown) of the same configuration as in FIG. 1. The secondary drive includes the brake 16 attached to the main drive motor shaft 20, the electric normally engaged clutch 46 and may include a mechanical centrifugal normally engaged clutch 47. For brevity, the worm 30 is shown, it being understood that the worm is meshed with a worm wheel, which again is connected to the drum 10, as shown in FIGS. 1 and 2.

The worm in the embodiment of FIG. 3, however, while also driven at a speed faster than the worm wheel 26, is driven continuously and only intermittently at a higher torque than the torque at its continuously driven condition. The torque is varied dependent upon the axial position of the worm and the relative directions of the worm and worm wheel. The worm is driven through a differential mechanism 92 and a clutching mechanism 94.

The secondary drive from the motor 14 via clutch 47 drives an input gear 96 which meshes with a side input gear 97. The side input gear is journaled on a differential shaft 98 and fixed to a first bevel gear 100 that is also journaled on shaft 98. First bevel gear 100 meshes with a central second bevel gear 102 that is rotatably journaled on a differential carrier 104 that is pinned to shaft 98. A gear 106 meshes with gear 102 and is rotatably mounted on shaft 98. Gear 106 is fixed to a side output gear 108. The side output gear 108 is rotatably mounted on shaft 98 and meshes with an output gear 109 that is keyed to a shaft 105 that is splined to a shaft 107. Shaft 107 is splined in the worm 30. The worm 30 is mounted for limited axial movement, and centered in brackets 113 by positioning springs 118 (FIG. 6). The worm 30 is mounted for rotation in the brackets 113, which are fixed to a slide 114. The slide 114 can reciprocate in a track 115 of a frame 116. Heavy shock-absorbins springs 110 and 112 center the slide in the frame. Shock-sbsorbing springs 110 and 112 provide partial shock absorption of the lower speed components of the main drive train and drum in an emergency stop situation.

Figure 3A:
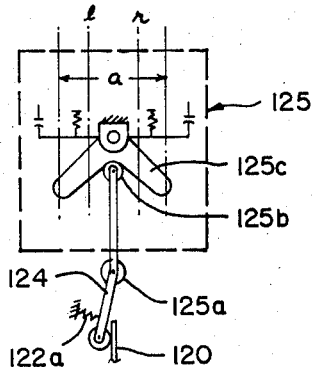
FIG. 3*a* is a schematic of one form of conventional worm axial position sensing switch.

A switch actuator ring 120 moves with axial movement of the worm 30. This acutator ring engages a switch actuator roller 122 biased by a spring 122*a*, the roller positions a switch operator arm 124. The switch 125 has a pivotal post 125*a* fixed to arm 124. The post is fixed to a cam operator 125*b* that rocks a cam follower switch bar 125*c*. When cam operator 125*b* is close to its center between "l" and "r," one set of switch contacts will be closed and the other opened. This switch contact change represents the condition when the worm tooth has been moved away at a high torque from a worm wheel tooth, but prior to the worm tooth engaging a next forward worm wheel tooth. The total axial excursion of the worm is represented by distance "a" (FIG. 3A). When the worm moves to its opposite axial position of normal operation, the cam operator 125*b* moves to the extreme right, opening the previously closed left switch contacts and closing the switch contacts on the right in FIG. 3A. In going from full left to full right, the left contacts get opened and the right contacts get closed when the operator 125*b* is between points "l" and "r" in FIG. 3A. This represents an axial position of worm 30 at a point where higher torque is disengaged from the worm and a lesser limited torque is applied to the worm-accelerating drive to move a worm tooth continuously against the next forward worm wheel tooth. Similarly, as the operator 125*b* moves from full right toward full left in FIG. 3A, the left switch contacts get closed and the right switch contacts open as the operator 125*b* reaches a position between "l" and "r." This will repeat the reduction of higher torque to the lower limited torque in the worm-accelerating drive but not in the opposite direction of rotation.

Stated differently, the worm is at the end of an axial excursion when running in one normal direction because the differential worm drive runs at a faster velocity than the tangential speed of the wheel. Upon a reversal, the worm is moved in the opposite direction at a higher torque until the ring 120 and thus the operator 125*b* reach a position between "r" and "l". At this location, the torque is decreased until the worm is again pushing slightly against the worm wheel tooth at the full excursion of the distance "a." When the contacts in FIG. 3A are opened and closed, respective conventional brakes 128 and 130 are energized or de-energized to increase the torque available out of the planetary to gear 109. The torque created by the brakes 128 and 130 is greater than the torque created on gear 109 by a drag 150 described later. The increased torque is necessary to overcome the frictional engagement of the worm wheel tooth against the worm tooth following a hoist reversal.

Operation of the differential assembly 90 to create this acceleration force in the embodiment of FIGS. 3 and 6 will now be described. In addition to the brakes 128 and 130, which are keyed to brake shafts 129 and 131, respectively, there are also pinions 132 and 134 which are locked to their respective shafts in one direction of rotation through conventional sprag clutches 133 and 135, and freewheel on their respective brake shafts in the other direction of rotation. These pinions are driven by a transfer gear 140, which is keyed to the differential shaft 98. The brakes 128 and 130 and sprag clutches 133 and 135 are part of another form of releasable coupling means. As explained earlier this brake and sprag arrangement causes the differential to provide a higher torque, which is necessary to move a worm tooth away from the tooth of the worm wheel when the hoist is reversed by the operator from hoist to lower, or vice versa.

In operation, assume the worm is running at full right in FIG. 3A. Pinion gear 132 will rotate freely in only one direction when the brake 128 is set. Similarly, pinion gear 134 will rotate freely in only one direction whe brake 130 is set. Thus, in normal operation, one of the two brakes 128 or 130 will be set, while the other brake is de-energized. This will always allow transfer gear 140 to rotate in a desired direction and thus allow differential shaft 98 to rotate to move the worm teeth in the same direction as the worm wheel teeth. The transfer gear can rotate because with one brake set the gear on that shaft will be freewheeling through its one way sprag clutch. The gear on the opposite brake shaft will be locked to its brake shaft through its one way sprague, but since that brake is not set on that shaft, the entire brake shaft can rotate. The choice of which brake 128 or 130 is energized (set) and which is de-energized (not set) is determined from the switch 125 and is dependent upon the position of switch arm 124 and thus operator 125*b*, which monitors the axial position of the worm 30. Thus, in the assumed full right position, assume the brake 128 will be set and the other brake 130 will be de-energized to allow the transfer gear to rotate and accelerate the worm at a speed greater than the speed of the worm wheel and in the same direction as the worm wheel.

Differential shaft 98 is held with a slight drag by a friction device 150 of a conventional type. Therefore, the resistance of 150 imposes a constant predetermined limited torque on gear 108 through the differential assembly. With this motion, the worm is advanced toward the next forward tooth of the worm wheel at a limited torque, but at a speed slightly greater than the worm wheel speed. This will cause the worm tooth to engage the next forward worm wheel tooth with a slight drag resulting from the drag 150. If the operator reverses the hoist, then the sprag device 133 on the brake shaft 129, which had been freewheeling on the shaft which was stopped by the set brake 128 at that time, will now try to reverse but will be locked by its brake 128 and will hold the transfer gear 140, stopping the differential shaft 98. All of the available torque (limited by the brake capability setting of brake 128) will now go through the differential gears 100, 102 and 106 resulting in a higher torque than when the differential shaft was rotating. This provides greater torque to unseat the worm tooth from the worm wheel tooth and start it in the opposite direction towards the next forward worm wheel tooth. The worm will advance axially now to the left. When the worm excursion reaches a point between "l" and "r" from its previous position at full right in the sketch of FIG. 3A, the left contacts are closed and the right contacts are opened to set the brake 130 on the other brake shaft 131, releasing the brake 128 on the first brake shaft 129 and thus releasing the transfer gear to begin rotating once more. Thus the worm is again driven at its original lesser torque determined by drag 150 to keep the worm at the opposite now left-hand end of the excursion "a."

In this embodiment, it must be understood that the three functions carried out by this system are: first, to accommodate accumulated slip in the torque-limiting device 18 where there is such a device in the system; second, to provide sufficient torque for the worm tooth to move away from the tooth it was contacting when the operator reverses the hoist; and finally, to provide the intelligence through the switch 125 to tell when the worm has begun to move away from the worm wheel tooth it has been pushing against. That is, the worm is always allowed to catch up in this embodiment to the worm wheel tooth which is ahead of it in its direction of movement; but during a reversal, it must get out of the way and requires more torque to do this. It should be understood that in the event of a failure, the worm will hold the worm wheel and the spring 110 will absorb part of the kinetic energy of the drive train. This will also result in movement of the slide 114 and activate an overload switch 300 as in FIG. 1 to de-energize the main motor 14 and open electric clutch 46. It should also be understood that other types of switch systems than switch 125 may be employed to energize and de-energize the brakes 128 and 130.

It should also be understood that the secondary drives 70 and 39 are interchangeable in all embodiments.

Figure 7:
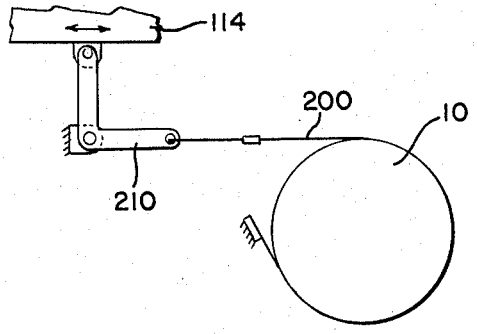
FIG. 7 is a schematic of another embodiment.

FIG. 7 shows still another emboidment in which the slide 114 can be used to actuate a switch and set a brake band 200 on the drum or can act through a bell crank 210 or other suitable mechanism to provide the motive power to set the brake 200. Suitable brake setting arrangements are shown in earlier identified applications Ser. Nos. 475,684 and 317,054, now U.S. Pat. Nos. 4,493,479 and 4,518,153 respectively, the details of which are incorporated herein by reference thereto. In this embodiment the slide will be moved axially by the worm 30 to compress springs 110 or 112 in a hazard condition. Rather than the worm then acting to stop the worm wheel and thus the drum, the brake on the drum which is set by movement of the worm stops the drum. An advantage of this embodiment is that the worm may be sized much smaller than would be necessary if the worm had to absorb the kinetic energy of the drum, load and drive train as in the embodiments shown in FIGS. 1–6. In this embodiment the energy is absorbed by the brake 200.

While various embodiments of the invention have been illustrated and described, it should be understood that various other embodiments will be apparent to one of ordinary skill in the art. For example, irreversible gearing can take other forms differing from the worm 30, the important function being that the drum cannot back-drive the gearing. Accordingly, the invention is not to be limited to the embodiments illustrated in the drawings.

We claim:

1. A safety system in a load-carrying hoist in which there is defined a last low-speed, load-carrying component, a last high-speed, load-carrying component including a drive motor, a power transmission main drive operatively coupled to the motor, a drum operatively coupled to the main drive, a worm wheel fixed on said last low-speed, load-carrying component operatively connected to the drum and having worm wheel teeth movable in a forward and reverse direction, a worm drive assembly having a worm tooth continuously in mesh with the worm wheel teeth for stopping said drum in the event of a hazard condition so as to provide emergency holding of the load, a secondary drive train drivingly coupled to the last high-speed, load-carrying component and to the worm assembly, and including automatic control means for automatically driving the worm tooth faster than the speed of the worm wheel teeth and in the same tangential direction of movement of the worm wheel teeth to drive a tooth of the worm forwardly away from the next rearward worm wheel tooth when traveling in the same direction and automatically vary the torque in the drive to the worm for generally synchronously, continuously moving the worm tooth in mesh with the forward and reverse movement of the worm wheel teeth.

2. The system of claim 1, said automatic control means including clutch means responsive to axial movement of the worm to couple the secondary drive train to the worm and accelerate a worm tooth out of engagement with the next rearward worm wheel tooth, and decouple the secondary drive train from the worm when the worm tooth has been moved out of pushing contact with the worm wheel tooth.

3. The safety system of claim 1, said automatic control means including a switch responsive to the axial position of the worm to convert the secondary drive from a higher torque to a lower torque drive to move the worm tooth forwardly against the next forward tooth on the worm wheel.

4. A safety system in a load-carrying hoist in which there is defined a last low-speed, load-carrying component, a last high-speed, load-carrying component including a main drive motor, a power transmission main drive operatively coupled to the motor, a drum operatively coupled to the main drive and to the last low-speed, load carrying component, a secondary drive including substantially irreversible gearing having a first portion with gear teeth driven by one power source and a second portion with gear teeth in mesh with the gear teeth of the first portion driven by the drum at a speed slower than the gear teeth of said first portion and wherein the drum cannot substantially back drive the first portion, thus holding the drum in the event of a hazard condition, positioning means for automatically engaging the first portion power source for accelerating the gear teeth of the first portion of the irreversible gearing to said gear tooth speed faster than the gear teeth of the second portion and in a direction out of interference with the gear teeth of the second portion of the irreversible gearing during normal operations, but allowing interference to lock the gear teeth of the second portion when a hazard condition occurs.

5. The system of claim 4, said one power source including a separate, independent drive motor.

6. The system of claim 4, said one power source including a planetary drive and releasable coupling means for changing the output torque out of the planetary drive in response to said positioning means for accelerating the gear teeth of the first portion at said greater speed than the gear teeth of said second portion and at a higher torque sufficient to disengage said meshing gear teeth from frictional engagement when the hoist is reversed during normal operation.

7. The system of claim 4, said second portion of the irreversible gearing including a worm wheel drivingly coupled to said last low-speed, load-carrying component, said first portion of said irreversible gearing including a worm, said positioning means including a releasable coupling means for accelerating the worm to only drive the worm out of frictional contact with the worm wheel during said normal operation.

8. The system of claim 7, said one power source for said first portion of the irreversible gearing including a secondary drive train driven by said last high-speed, load-carrying component and coupled to said releasable coupling means for accelerating the worm teeth out of interference with the worm wheel teeth.

9. The system of claim 4, said first portion including a worm, positioning means including means for mounting said worm for axial movement and wherein the axial movement of the worm actuates the acceleration of the gear teeth of the first portion of the irreversible gearing.

10. The system of claim 4, including energy absorption means for dissipating energy through the irreversible gearing and main drive when an emergency stop by the irreversible gearing occurs.

11. The system of claim 7, said positioning means including spring means mounting the worm for partially absorbing the kinetic energy caused by interference between the worm teeth and the worm wheel teeth during an emergency stop in a hazard condition, and including an energy-absorbing torque limiter in the main drive to absorb the remainder of the kinetic energy during such emergency stop.

12. The system of claim 7, said releasable coupling means including a set of outer cone clutch faces driven at a speed to move a tooth on the worm faster than a tooth on the worm wheel, a pair of central clutch plates engageable with said outer cone clutch faces and drivingly coupled to said worm, said central clutch plates being operable to rotate the worm by engaging with the outer cone clutch faces when the worm wheel tooth catches up and pushes the worm tooth, but automatically uncoupling the rotational drive to the worm when the worm tooth becomes moved away from the worm wheel tooth.

13. The system of claim 7, said releasable coupling means including an input gear coupled to the last high-speed, load-carrying component, a side input gear meshing with the input gear and journaled on a differential shaft, a differential first bevel gear fixed to said side second gear, a differential central second bevel gear meshing with said first bevel gear and journaled on a carrier assembly, a differential third bevel gear meshing with said central second bevel gear and fixed to a side output gear that is journaled on said differential shaft, an output gear driven by said side output gear, a transfer gear fixed to said differential shaft, and a set of automatically controlled brake assemblies drivingly coupled to said transfer gear for allowing rotation of said differential shaft at a lower torque but increasing the ouput torque to the worm when the brake assemblies hold the differential shaft.

14. The system of claim 13, said brake assemblies each including a pinion gear spragged by one-way sprag clutches to a brake shaft and meshing with said transfer gear, an electrically operated brake on each brake shaft, said brakes each stopping a respective brake shaft during alternate rotational directions of the differential shaft when a worm tooth is pushed by a next rearward worm wheel tooth to cause the differential gears to accelerate the worm to move the tooth away from the next rearward worm wheel tooth at a high torque, and switch means for de-energizing a set brake on its brake shaft to reduce the torque driving the worm after the worm tooth is moved away from the pushing worm wheel tooth.

15. The system of claim 4, including overspeed protection means for disconnecting said one power source to the first portion of the irreversible gearing to cause the worm to stop the worm wheel.

16. The system of claim 4, including motor disconnect means for automatically de-energizing the main drive motor in response to axial movement of the worm when stopping the worm wheel in a hazard condition.

17. The system of claim 15, including motor disconnect means for automatically de-energizing the main drive motor in response to the worm stopping the worm wheel.

18. The system of claim 7, including means for driving said worm to lower a load after said drum has been stopped from a hazard condition.

19. A hoist comprising a drive motor, a main gear reduction drive unit driven by the motor, a drum driven from the drive unit, normally irreversible drive means continuously drivingly engaged for stopping the drum in a hazard condition, said irreversible drive means including a worm wheel drivingly coupled to the drum, a worm having teeth meshed with teeth on the worm wheel, means responsive to pushing contact of a worm wheel tooth against a worm tooth only when both are moving in the same direction as in normal operation for increasing the speed of the worm relative to the worm wheel to advance the worm tooth out of engagement with the worm wheel tooth for substantially synchronizing the speeds of the worm and worm wheel teeth, said speed-increasing means becoming operative to lock the worm wheel with the worm when said directions of the worm wheel and worm teeth are opposite to one another in an abnormal hazard condition, shock-absorbing means allowing axial movement of the worm to absorb part of the kinetic energy of the motor drive unit and drum during an emergency stop, torque-limiting means in the drive unit for absorbing the remainder of the kinetic energy during an emergency stop, and overspeed protection means for automatically triggering a lock-up between the teeth of the worm and worm wheel for an emergency stop when the drum runs beyond its rated normal speed.

20. A safety system for a hoist of the type comprising a main drive motor, a main drive train coupling the motor to the drum, and a control for reversing the direction of the main drive motor, the improvement comprising a worm wheel coupled to the drum, a worm having teeth meshing with teeth on the worm wheel, means for automatically accelerating the worm to give a tooth on the worm a speed greater than the speed of a tooth on the worm wheel to move a tooth on the worm away from a tooth on the worm wheel during reversal of the main drive motor and at a torque sufficient to overcome frictional contact between the meshing teeth of the worm and worm wheel.

21. The system of claim 17, said means for accelerating the worm including first means for rotating the worm at a first predetermined torque and at a speed greater than that of the worm wheel for continuously pushing the worm teeth against the worm wheel teeth, said means for accelerating the worm including second means for rotating the worm at a torque greater than said first predetermined torque.

22. The system of claim 17, said means for accelerating the worm being energized by axial movement of the worm caused from pushing by the worm wheel against the worm.

23. The system of claim 17, said means for acclerating the worm at a higher torque being intermittently engaged by axial movement of the worm.

24. The system of claim 17, including a one-way clutch between the motor and the worm wheel for preventing transmission of motor rotation to the worm wheel in the downward lowering direction so that the motor energy cannot be imposed on the worm wheel.

25. The system of claims 1 or 17 in which the worm may move axially through a limited distance and the axial movement of the worm actuates a brake on the drum.

26. The system of claims 1 or 17 in which the worm itself acts as the brake.

27. The system of claim 1, a one way clutch in the power transmission main drive for transmitting power to drive the drum in a hoist direction but not transmitting power to drive the drum in the lowering direction to reduce the load on the work in a hazard condition.

28. The system of claim 4, means positioned between the last high-speed, load-carrying component and the drum for powering the drum in the hoisting direction but not powering the drum in the lowering direction to reduce the lowering load on the second position of the irreversible gearing in the event a hazard condition occurs.

* * * * *